US006588977B1

(12) United States Patent
Stayner

(10) Patent No.: US 6,588,977 B1
(45) Date of Patent: Jul. 8, 2003

(54) COMPACTOR MACHINE HAVING VIBRATION DAMPING MEANS

(75) Inventor: Richard Stayner, Ludlow (GB)

(73) Assignee: Benford Limited, Warwick (GB)

( * ) Notice: Subject to any disclaimer, the term of this patent is extended or adjusted under 35 U.S.C. 154(b) by 0 days.

(21) Appl. No.: 09/710,014

(22) Filed: Nov. 10, 2000

(30) Foreign Application Priority Data

Nov. 13, 1999 (GB) ..... 9926821

(51) Int. Cl.[7] ..... E01C 19/30
(52) U.S. Cl. ..... 404/133.1; 404/133.05
(58) Field of Search ..... 404/113, 133.05, 404/133.1

(56) References Cited

U.S. PATENT DOCUMENTS

| | | | | |
|---|---|---|---|---|
| 3,782,845 A | * | 1/1974 | Briggs et al. | 404/133.1 |
| 4,043,694 A | | 8/1977 | Mullen | |
| 4,067,244 A | | 1/1978 | Baumers | |
| 5,645,370 A | | 7/1997 | Zürbes et al. | |
| 5,934,825 A | * | 8/1999 | Waldenberger | 404/133.1 |

FOREIGN PATENT DOCUMENTS

| | | | | |
|---|---|---|---|---|
| BE | 672035 | | 11/1965 | |
| DE | 2132700 | | 1/1972 | |
| DE | 3203463 | * | 6/1983 | 404/133.1 |
| DE | 29804993 U1 | | 7/1998 | |
| EP | 0054529 A1 | | 6/1982 | |
| EP | 1026322 A1 | | 8/2000 | |
| GB | 1373427 | | 11/1974 | |
| GB | 1396373 | | 6/1975 | |
| GB | 2016563 A | | 9/1979 | |
| GB | 1578696 | | 11/1980 | |
| GB | 2115466 A | | 9/1983 | |

* cited by examiner

*Primary Examiner*—Heather Shackelford
*Assistant Examiner*—Sunil Singh
(74) *Attorney, Agent, or Firm*—MacMillan, Sobanski & Todd, LLC

(57) ABSTRACT

A compactor machine adapted to be controlled by a pedestrian operator. The compactor machine includes a base plate adapted to engage a material to be compacted and an operative unit mounted on the base plate to cause the base plate to vibrate when in use. The compactor machine further includes a handle which is mounted on the operative unit by means of a plurality of first damping mounts which are spaced from the base plate. The handle is pivotable relative to the operative unit.

18 Claims, 4 Drawing Sheets

COMPACTOR MACHINE HAVING VIBRATION DAMPING MEANS

BACKGROUND OF THE INVENTION

The invention relates to a compactor machine and in particular to one of the kind operated by a pedestrian for fairly light compacting of the ground.

Compactor machines of this kind are generally known as forward vibrating plate compactors, and many slightly different forms are known. In general they comprise an engine which transmits power via a pulley belt to an eccentric mass unit attached to a base plate. The mass is rotated generating a centrifugal force, and simultaneously applying a downward force with motion in a forward direction. The machine is guided by a pedestrian operator via a steering handle.

A major problem with many of the prior ale compactors of this type is the level of vibration transmitted to the hands of the operator, and generally known as Hand-Arm Vibration (H.A.V.). Various approaches to the problem have been tried without much success, as significant vibration is still transmitted. This can lead to a medical condition, commonly known as Vibration White Finger, in operators who use these machines for extended periods of time, and which is clearly undesirable. The European Union has issued guidelines for safe levels of H.A.V., which can be experienced over an eight hour duration, of 2.5 $ms^{-2}$. If manufacturers produce machines with levels of H.A.V. higher than this level they are required to state this in their product literature.

Clearly, if the level of H.A.V. can be reduced the operators' health and comfort are considerably enhanced and longer working periods can also be contemplated.

It is an object of tie present invention to mitigate the above described problem.

SUMMARY OF THE INVENTION

According to the present invention there is provided a compactor machine of the kind controlled by a pedestrian operator and including a base plate, and mounted on the base plate an operative unit including means to cause the base plate to vibrate when in use, and a handle wherein the handle is mounted on the operative unit by means of a plurality of first damping mounts distant from the base plate, and the handle is pivotable relative to the operative unit.

The operative unit may comprise a support plate and a main frame, and wherein the handle is pivotally mounted on the main frame.

The mainframe may substantially define the outer dimensions of the operative unit.

The plurality of first damping mounts conveniently comprises four arranged substantially in a rectangle in a horizontal plane.

Preferably the handle is pivotally mounted on the main frame via an secondary frame which is mounted on the main frame by means of the plurality of first damping mounts.

The plurality of first damping mounts may have a stiffness in the range 10 to 20 $Nmm^{-1}$, or it may be in the range 12.5 to 17.5 $Nmm^{-1}$.

Preferably the operative unit is mounted on the base plate by means of a plurality of second damping mounts.

The plurality of second damping mounts generally comprises four arranged substantially in a rectangle.

Conveniently the plurality of second damping mounts have a stiffness in the range 30 to 70 $Nmm^{-1}$, or it may be in the range 40 to 60 $Nmm^{-1}$.

BRIEF DESCRIPTION OF THE DRAWINGS

An embodiment of a compactor machine according to the invention will now be described with reference to the accompanying drawings in which.

DESCRIPTION OF THE PREFERRED EMBODIMENTS

Figure 1:
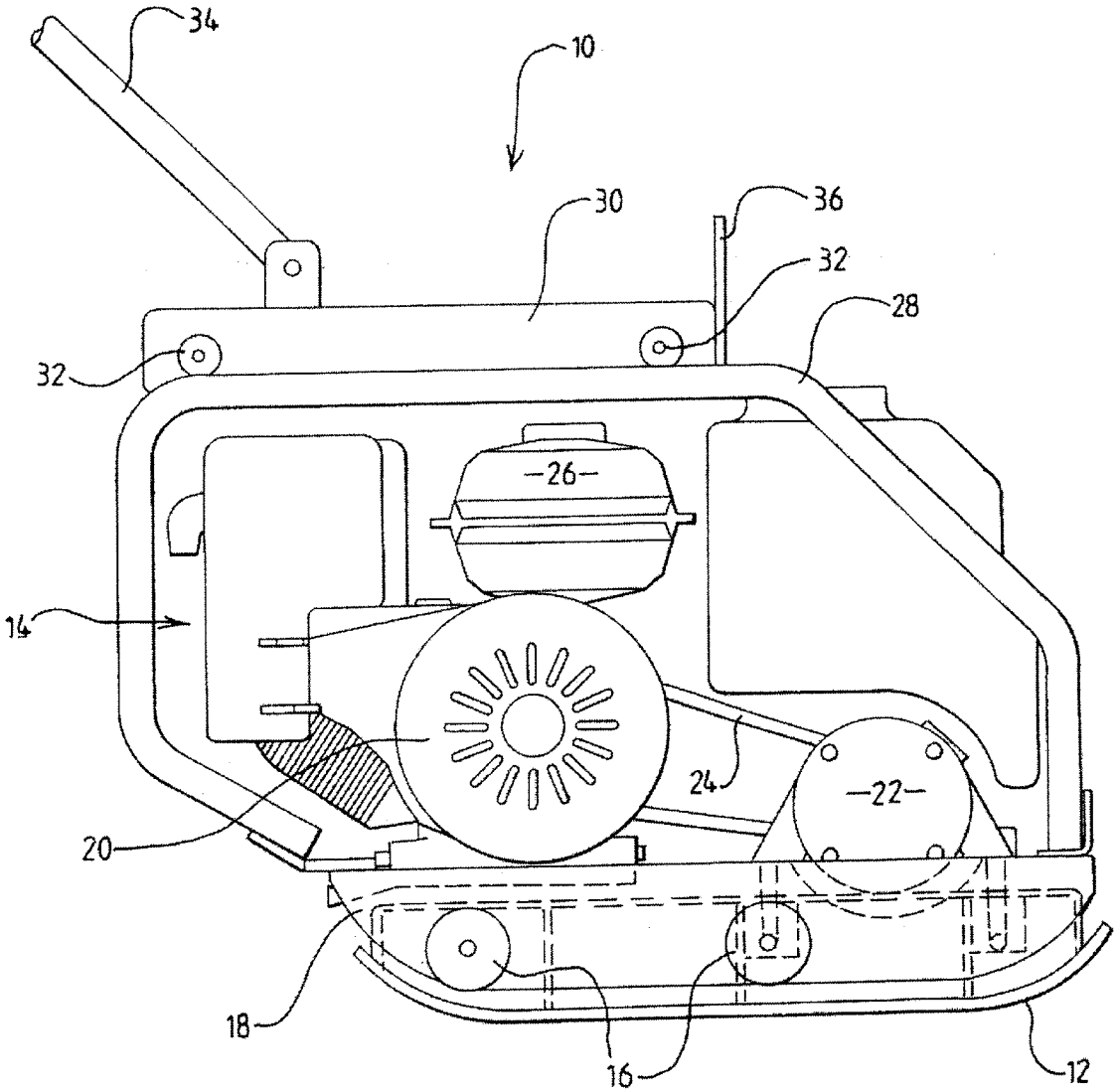
FIG. 1 is a simplified side view of the compactor machine according to the invention.
Figure 2:
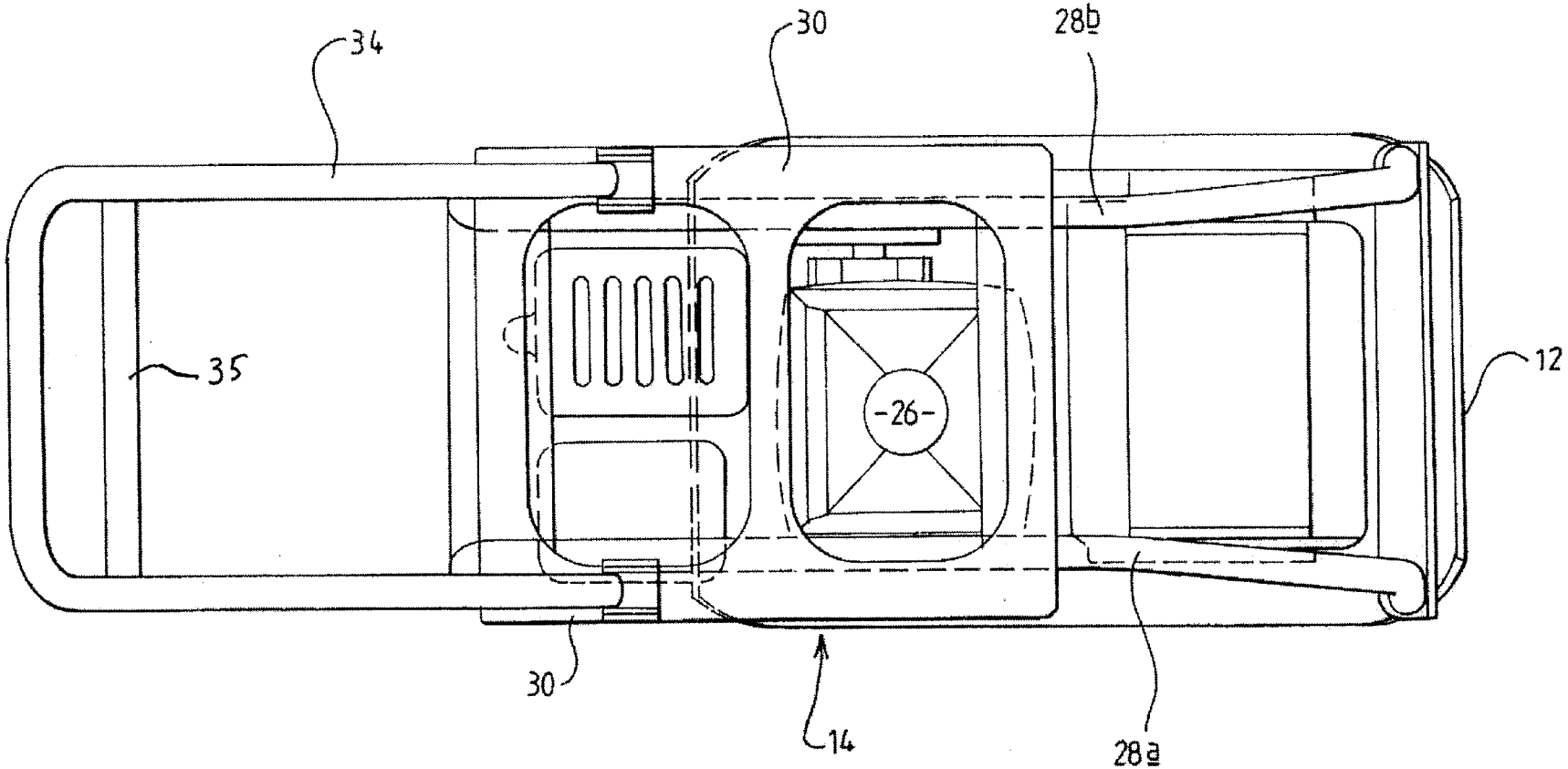
FIG. 2 is a simplified plan view of the compactor machine of FIG. 1.
Figure 3:
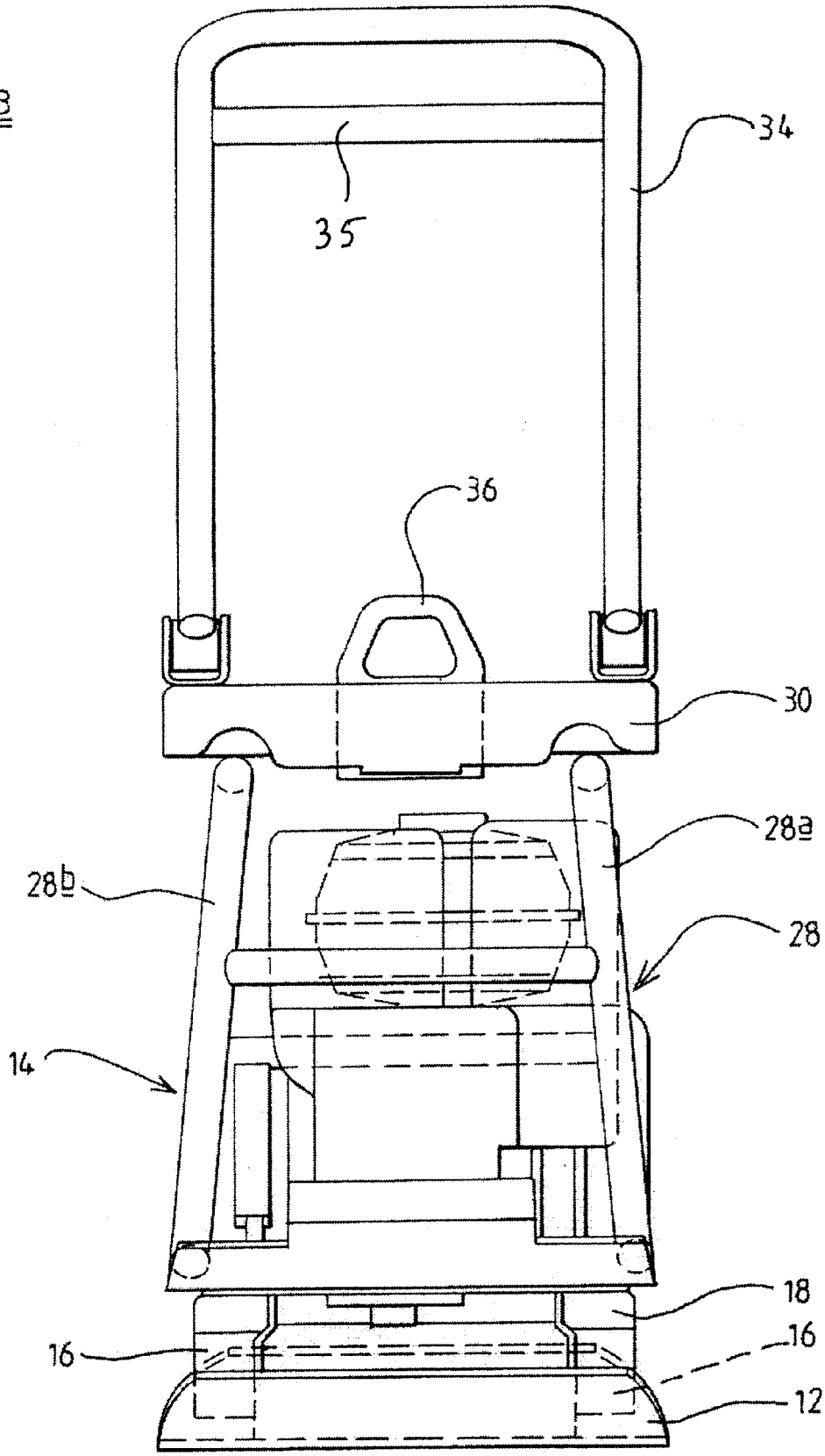
FIG. 3 is a simplified r ear view of the compactor machine of FIGS. 1 and 2.
Figure 4:
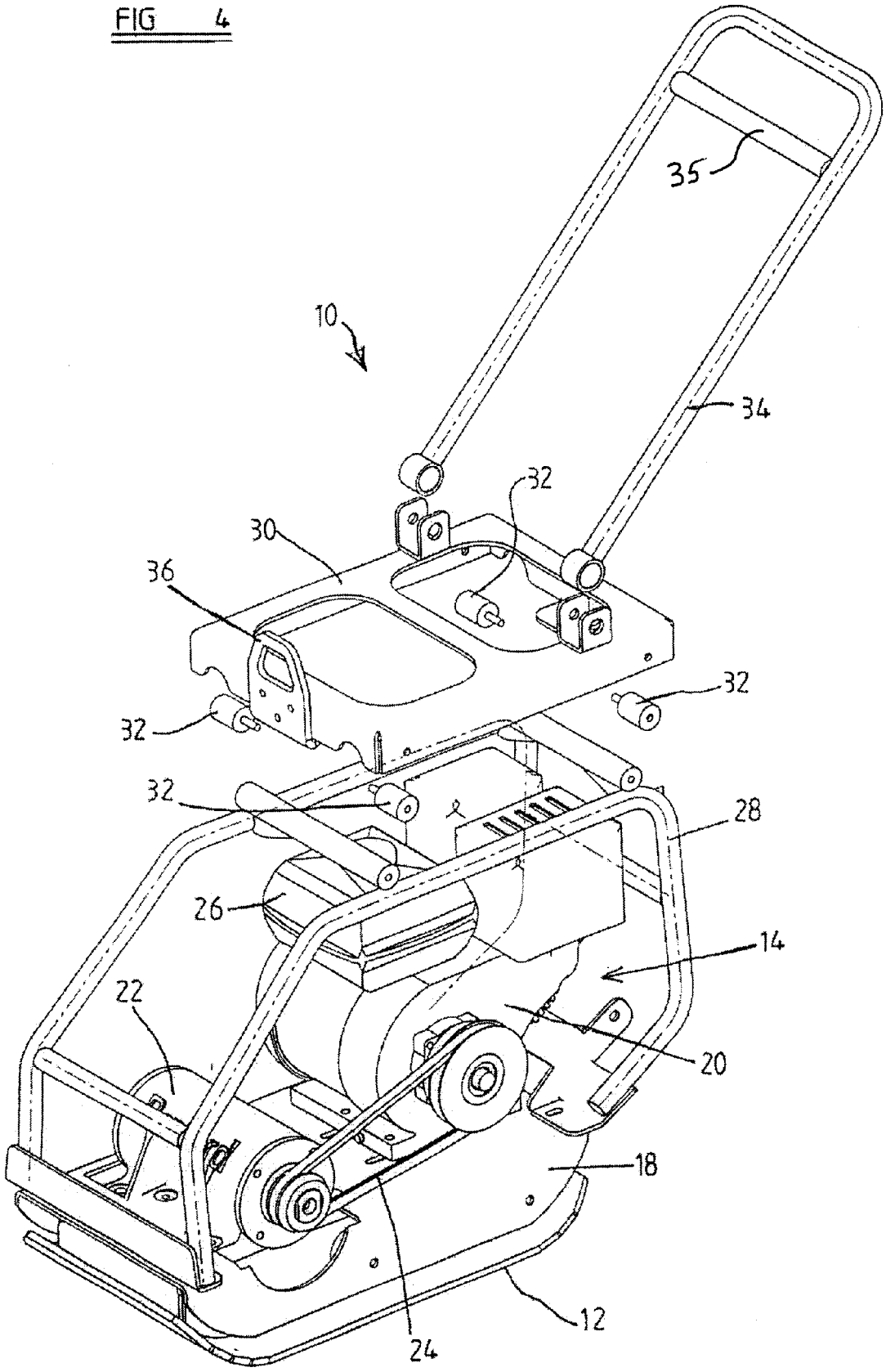
FIG. 4 is a partially exploded perspective view of the compactor machine of FIGS. 1 and 2.

Referring now to the Figures, a compactor machine 10 is of the kind generally known as a forward vibrating plate compactor. It includes a base plate 12 on which is supported an operative unit 14 by means of primary damping mounts 16. There are four primary damping mounts 16 arranged in a rectangle, two on each side of the machine 10 with their outer edges separated by 295 mm. The pairs on each side of the machine 10 are themselves separated forwardly and rearwardly, with their centres 220 mm apart. The primary damping mounts 16 take the form of relatively stiff rubber having a stiffness in the range 30 to 70 $Nmm^{-1}$, with the value of 50 $Nmm^{-1}$ being preferred in many instances.

The operative unit 14 includes a support plate 18, with mounted thereon an engine 20. The engine 20 includes a fuel tank 26. The operative unit 14 also includes an eccentric mass 22 which is driven by the engine 20 by means of a drive belt 24. The eccentric mass 22 is mounted on the base plate 12, which is separate from the operative unit 14. When the eccentric mass 22 is rotated or driven by the engine 20, it causes the base plate 12 to vibrate.

The frequency of operation of the machine 10 is 98 Hz, but could by any where in the range 90–105 Hz. The machine 10 has a weight of 75 kg, but that could lie in the range 65–851 kg.

The compactor machine 10 also includes a frame 28 which has two tubular parts 28*a* and 28*b* one on each side of the machine 10. The parts 28*a* and 28*b* are each substantially "C" shaped, with one end secured to the support plate 18 at the rear and the other end secured to the support plate 18 at the front, and cross braces between the two parts 28*a* and 28*b*.

The compactor machine 10 further comprises a secondary frame 30 which is substantially rectangular in shape and which is mounted upon the frame 28 by means of damping mounts 32. In this embodiment there are four damping mounts 32 arranged in a rectangle, two on each side of the machine 10 with their outer edges separated by 340 mm. Each pair is separated forwardly and rearwardly, with their centres 340 mm apart. The forward damping mounts 32 are located 95.5 mm in front of the centre of the engine 20. The damping mounts 32 take the form of relatively softer rubber having a stiffness in the range 10 to 20 $Nmm^{-1}$, with the value of 15 $Nmm^{-1}$ being preferred in many instances.

A steering handle 34 is pivotally secured to the secondary frame 30, such that it may be used at a comfortable angle by an operator, and folded flat towards the machine 10 for storage. The handle 34 is pivoted 70 mm in front of the rearward damping mounts 32. The handle 34 is conveniently formed from bent steel tube and has a cross-member 35 towards its upper end. The cross-member 35 has been formed to reduce transmission of vibrations up the handle 34 best when formed of solid bar, rather than tube with a weight in excess of 1 kg.

Also secured to the secondary frame 30, towards the front, i.e. distant from the steering handle 34, is a lifting handle 36 to assist in lifting the machine 10 when required.

The embodiment described above provides the advantage that the damping mounts 32 and the general arrangement of the frames 28, 30 significantly reduces the vibrations passed from the operative unit 14 to the steering handle 34, and thus reduces the vibration transmitted to the operator's hands.

Variations to the above described embodiment may be made whilst remaining within the scope of tile invention. For example there may be more or fewer damping mounts 16 and/or 32, and they may be arranged in other ways. Further, the damping mounts 32 and 16 themselves need not be made of rubber but may be formed of any appropriate material. The various dimensions given above may also be varied as appropriate for other weights of machine and individual components such as the engine. Likewise the weight and frequency of operation may vary outside the ranges given if appropriate.

The main frame 28 need not define the outer dimensions of the operative unit 14 as shown in the drawings. In alternative embodiments the main frame may not reach to the top of the other components (e.g. fuel tank), but may instead stop short, the secondary frame 30 would then extend further down to meet the main frame.

In the present specification "comprise" means "includes or consists of" and "comprising" means "including or consisting of".

The features disclosed in the foregoing description, or the following claims, or the accompanying drawinigs, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A compactor machine adapted to be controlled by a pedestrian operator and including a base plate adapted during use to engage a material to be compacted, an operative unit including a support plate, an engine mounted on said support plate and means adapted to be driven by said engine to cause said base plate to vibrate when in use, a frame mounted on said support plate, at least a portion of said frame extending away from said base plate and from said support plate, a handle pivotable relative to said frame, and a plurality of first damping mounts spaced from said base plate mounting said handle to said frame at a location distant from said base plate.

2. A compactor machine according to claim 1 wherein said frame substantially surrounds said engine.

3. A compactor machine according to claim 1 wherein said plurality of first damping mounts comprises four first damping mounts arranged substantially in a rectangle in a horizontal plane.

4. A compactor machine according to claim 1 wherein said frame comprises a main frame mounted on said support plate and a secondary frame, wherein said handle is pivotally mounted on said secondary frame and wherein said secondary frame is mounted on said main frame by means of said plurality of first damping mounts.

5. A compactor machine according to claim 4, wherein said plurality of first damping mounts comprises four first damping mounts arranged substantially in a rectangle in a horizontal plane.

6. A compactor machine according to claim 1 wherein said plurality of first damping mounts have a stiffness in the range of 10 to 20 $Nmm^{-1}$.

7. A compactor machine according to claim 1 wherein said plurality of first damping mounts have a stiffness in the range of 12.5 to 17.5 $Nmm^{-1}$.

8. A compactor machine according to claim 1 wherein said support plate is connected to said base plate by means of a plurality of second damping mounts.

9. A compactor machine according to claim 8 wherein said plurality of second damping mounts comprises four second damping mounts arranged substantially in a rectangle.

10. A compactor machine according to claim 8 wherein said plurality of second damping mounts have a stiffness in the range of 30 to 70 $Nmm^{-1}$.

11. A compactor machine according to claim 8 wherein said plurality of second damping mounts have a stiffness in the range of 40 to 60 $Nmm^{-1}$.

12. A compactor machine, as set forth in claim 1, and wherein said means adapted to cause said base plate to vibrate when in use includes an eccentric mounted on said base plate, and means connecting said eccentric to be rotated by said engine when said compactor machine is in use.

13. A compactor machine adapted to be controlled by a pedestrian operator and including a base plate adapted during use to engage a material to be compacted, an operative unit mounted on said base plate and including means to cause said base plate to vibrate when in use, said operative unit including a support plate mounting an engine connected to drive said means to cause said base plate to vibrate, a main frame mounted on said support plate, a secondary frame, a plurality of first vibration dampers mounting said secondary frame to said main frame to extend above said engine, and a handle pivotally mounted on said secondary frame at a location above said engine.

14. A compactor machine as set forth in claim 13, and wherein said first dampers are arranged substantially in a rectangle in a horizontal plane.

15. A compactor machine as set forth in claim 14, and wherein said plurality of first dampers have a stiffness in the range of 10 to 20 $Nmm^{-1}$.

16. A compactor machine set forth in claim 13, and further including a plurality of second vibration dampers connecting between said support plate and said base plate.

17. A compactor machine, as set forth in claim 16, and wherein said first vibration dampers are arranged substantially in a rectangle in a first substantially horizontal plane above said means to cause said base plate to vibrate, and wherein said second vibration dampers are arranged substantially in a rectangle in a second substantially horizontal plane below said means to cause said base plate to vibrate.

18. A compactor machine, as set forth in claim 17, and wherein said plurality of first dampers have a stiffness in the range of 10 to 20 $Nmm^{-1}$ and said plurality of second dampers have a stiffness in the range of 30 to 70 $Nmm^{-1}$.

* * * * *